United States Patent [19]

Crouch

[11] 4,433,636

[45] Feb. 28, 1984

[54] DUAL WARNING PARKING AID

[76] Inventor: Ronald A. Crouch, 779 S. Willow Glenn Dr., Tipp City, Ohio 45371

[21] Appl. No.: 346,396

[22] Filed: Feb. 5, 1982

[51] Int. Cl.[3] ..... G01C 5/00

[52] U.S. Cl. ..... 116/28 R; 33/264; 116/205

[58] Field of Search ..... 116/28 R, 205; 33/264

[56] References Cited

U.S. PATENT DOCUMENTS

| | | | |
|---|---|---|---|
| 1,981,188 | 11/1934 | Pavitt | 116/28 R |
| 2,454,896 | 11/1948 | Traub | 116/28 R |
| 2,706,462 | 4/1955 | Evans | 116/28 R |
| 2,854,942 | 10/1958 | Ross | 116/28 R |
| 3,793,981 | 2/1974 | Sparks | 116/28 R |
| 4,036,165 | 7/1977 | Wood | 116/28 R |
| 4,101,868 | 7/1978 | Bubnich | 116/28 R X |
| 4,285,138 | 8/1981 | Berry | 33/264 |

*Primary Examiner*—Daniel M. Yasich

*Attorney, Agent, or Firm*—Joseph Patrick Burke

[57] ABSTRACT

This disclosure is directed to a dual visual indicator vehicle parking aid comprising a base, a first readily deflectable parking limit visual warning member suspended from an upper portion of a bendable second parking limit visual warning member by a flexible means joining said second warning member to said first warning member, wherein said second warning member is bendable to a fixed position and is activated by contact with a bumper on said vehicle whereas said first warning member is activated by contact with the front or rear end thereof so as to give two visual warnings independently of one another.

8 Claims, 3 Drawing Figures

DUAL WARNING PARKING AID

BACKGROUND OF THE INVENTION AND PRIOR ART

There has been a long standing but largely unfullfilled need for a parking aid to enable the driver of a car or other vehicle to successfully park same in a garage without damaging the front wall of the garage or whatever may be stored in a position adjacent thereto, viz., between the car and the garage wall. The term "front wall" as used herein is intended to denote the wall the driver of the vehicle approaches as the vehicle is pulled into said garage or other parking facility.

Many parking aid devices have been proposed in the prior art and each one has its own advantages and disadvantages. However, there is a long unfullfilled need for a parking aid which is capable of not only informing the driver of the vehicle when to stop same to avoid damaging the front wall of the garage, or material stored adjacent thereto, but also is inexpensive, will not readily break and can be reset or repositioned if judgemental parking errors are made.

The present invention offers a combination of beneficial properties and features at a minimum cost since it uses readily available, inexpensive materials. The parking aid of this invention offers a dual visual warning and is comprised of a readily deflectable spherical or other configuration first visual warning member secured to a separate bendable member, preferably a tubular metal standard or shaft, constituting a second visual warning member, by a flexible means such as a chain, rope, string, etc. A base for the shaft completes the assembly. The operation of the dual visual warning device of this invention is such that a first visual warning member contacts the forward most portion of the front end, or rear end of the car or other vehicle being parked, causing its deflection readily forward away from the driver toward the front wall of the garage. The second visual warning is bumper activated and occurs later when the forwardmost portion of the front or rear bumper touches the bendable shaft causing it to bend or rotate (rock) toward the garage front wall depending on whether the base is fixedly secured to the garage floor or not.

As noted above, various particular parking devices are illustrated in the prior art. U.S. Pat. No. 1,981,188 to W. H. Pavitt is directed primarily to a single visual indicator type of target C mounted on a flexible metal bar $c^1$ such that when the car bumper b touches the flexible metal bar, it deflects the indicator on target producing a rearward motion as an indicator at eye level to the driver of the automobile B. The flexible metal bar can be bent at an angle so as to be perceived by the driver of the automobile when contacted by the rear bumper of the car (FIG. 6). In place of the flexible metal bar, a rope, chain or other flexible element can be employed as per FIGS. 7, 8, and 9. However, such alternate flexible element is likewise bumper actuated. The bumper-actuated embodiment of FIG. 9 can utilize two visual indicators, but both of these are actuated at the same time upon contact with the car bumper. The present invention is distinguished from Pavitt in that the first and second dual indicators operate at different times dependent upon contact with different portions of the car (hood or rearend and bumper) as adjusted by bending of the bendable shaft or standard.

U.S. Pat. No. 2,854,942 to J. A. Ross and U.S. Pat. Nos. 3,817,203 and 3,874,322 issued to William Alvin Brauer are directed to the use of ball-like visual indicators suspended from the region of the garage ceiling, which contact the automobile windshield when the car has progressed sufficiently towards the garage front wall. U.S. Pat. Nos. 3,817,203 and 3,874,322 are movable parking indicators which move in conjunction with the garage door such that when the garage door is open, the parking aid device is lowered to a position where it will contact the automobile windshield when in the desired forward position. When the garage door is closed, the indicator is retracted upward towards the guides or tracks on which the garage door rollers or pulleys travel.

U.S. Pat. No. 3,793,981 to Meridith P. Sparks is directed to a combination of a plumb, a plumbline, and a light weight object, such as a spherically shaped "brusher" with its separate line, suspended from the garage ceiling. The plumb provides the driver of the vehicle with an indication as to where the centerline of the car should be steered whereas the brusher deflects in response to movement of the front or hood portion of the car.

U.S. Pat. No. 4,036,165 to Harmin V. Wood is a parking guide, activated by the bumper of the vehicle, to simultaneously actuate an audible and a visible signal to aprise the driver of his progress in parking the car. The audible signal is a bell which is sounded by first cocking and then releasing a spring hammer whereas the visible signal is a rectangular reflector supported on a shaft which is cam operated to pivot through 90° so that its full face is in front of the driver to indicate proximity to the impending garage wall. The reflectors mounting post also supports a small, brightly colored sphere which may be used as a reference to indicate the center of the parking lane to the driver.

U.S. Pat. No. 2,706,462 issued to D. J. Evans is directed to a pair of garage door guides mounted on the sides of the entrance way into the garage comprising a pair of return bend brackets integral with spring rods, each having a stationary, resilient ball mounted at the top portion thereof with an intermediate resilient slidable ball 17 which can be adjusted to appropriate heighths depending upon the proportions of the automobile parked in the garage. The driver watches the upper ball 20 to gauge his distance between the side portions of the entrance way to the garage so as to avoid hitting same.

U.S. Pat. Nos. 3,121,416 to J. M. Gizdich, 3,219,972 to L. R. Williams and 3,261,321 to O. Mandl illustrate other variations on bumper-actuated visual and audio parking aids employed in automobile garage situations.

DETAILED DESCRIPTION OF THE INVENTION

Figure 2:
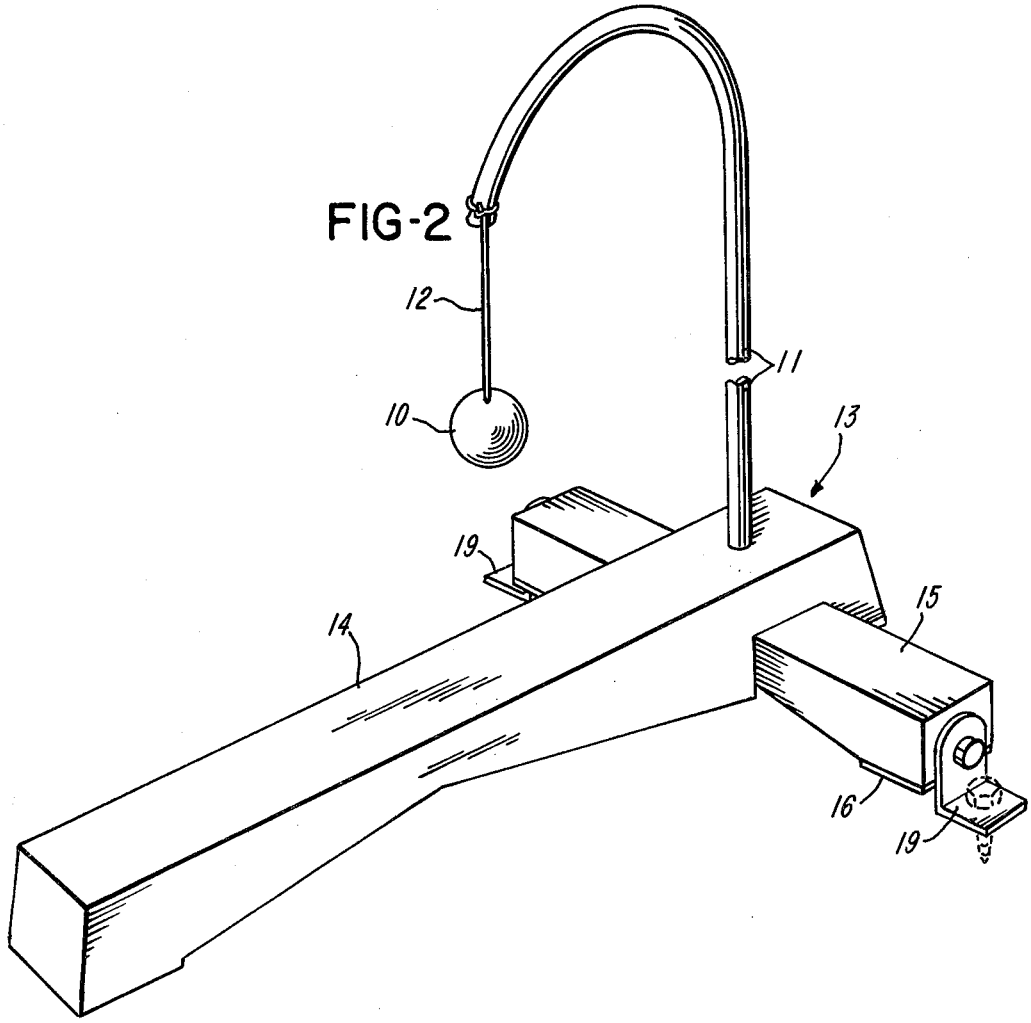
FIG. 2 is a prospective view of the dual warning aid device of this invention showing its component parts.
Figure 3:
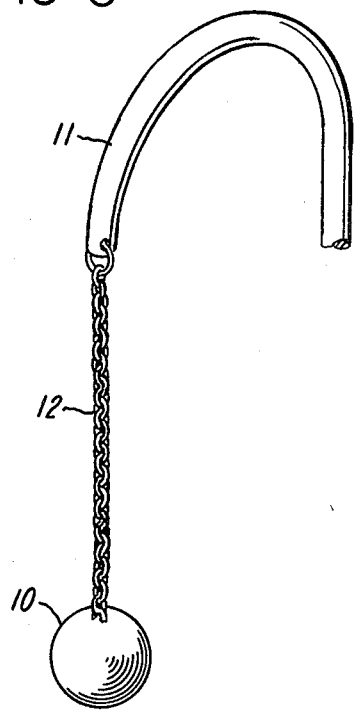
FIG. 3 is a partial prospective view illustrating an alternate (chain) form for flexible means 12.

As will be noted from FIG. 2 of the drawings, the dual visual warning parking aid of this invention is comprised of a readily deflectable first visual warning member 10 in the form of a ball, cylinder or other shape suspended from a bendable standard, post or shaft 11 by a flexible chain, rope, string or line 12.

Figure 1:
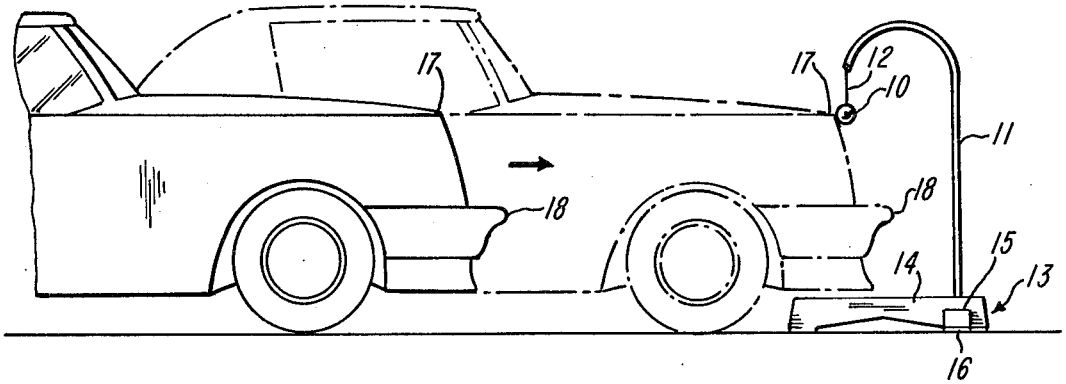
FIG. 1 is a side view showing an automobile in two positions, one (solid line) position partially inside the garage and another (phantom line) position whereby the front portion of the hood 17 thereof just contacts the first of the two visual warning aids.

It will be noted that the standard or shaft 11 is bendable and can be hand bent to various fixed configurations to preset same to accomodate varying distances between the front hood or front body portion of the automobile shown in FIG. 1 so that the initial warning to the driver is by contact of a forward portion of the front end, e.g., hood (or corresponding portion of the rear end of the car) with said member 10. This first readily deflectable parking limit visual warning member is located in a position closer to the driver of said vehicle and further from the subject wall in the area where said vehicle is being parked. The material from which the member 10 is made is a material which can be contacted by the portion of the car without damaging either it or the car surface, e.g., wood, plastic, paper, foam rubber, foam plastic, etc. Member 11 is preferably made of tubular metal, e.g., copper tubing having gauges of about 0.100 to about 0.500 inch (viz., 100 to 500 mils.), but it can be made of any material which is bendable to a fixed position to preset it in accordance with the vehicle's front or rear end configuration. Thus member 11 makes this parking aid initially selectively adaptable to whatever car configuration encountered.

As the automobile is further moved into the garage, or other parking area, the front most portion (or rear most portion should the car be backed into the garage) of the bumper 18 contacts the bendable standard or shaft 11 at the bottom portion thereof, either rotating it forward and/or bending it forward (depending on whether and how the base 13 is secured to the garage floor), thus providing the second visual indication.

At the bottom portion of the shaft 11, it is secured to a floor-mounted base means 13, which as illustrated in FIG. 2, has each of its upper and lower cross members 14 and 15, respectively, notched at their respective lower and upper surfaces to meet with the corresponding notched portions of its opposing cross member, with the two cross members 14 and 15 forming the base for the shaft 11. The bottom portions of selected areas of forward (upper) cross member 15 can be provided with pads 16, which may be provided with an adhesive lower surface, such as double surfaced adhesive tape, adhesive coated or impregnated pads, etc., to secure it to the garage floor in a lightly adhesive or temporary way, viz., the cohesive forces of member 15 exceeds the adhesion between 16 and the garage floor. However, this it not necessary as the base can be, and preferably is, free-standing. Alternatively, base 13 can be permanently secured to the garage floor with (or without) pivot arm(s) 19 at the end(s) of cross member 15, e.g., as shown in FIG. 2. When the base 13 is free-standing, contact of bumper 18 with standard 11 will initially cause the base and standard 11 to rock forward with rear cross member 14 tilting upward underneath the front end of the car. If portion 14 meets an obstruction, due to the geometry of the particular car being parked, standard 11 will bend forward. Basically, the same maneuvers will occur if both ends of forward cross member 15 are pivotally mounted at 19 to the garage floor. On the other hand, if the base is permanently secured to the garage floor, continued contact of bumper 18 with standard 11 will cause progressive bending of shaft 11 forward toward the garage front wall. Securing the bottom end portions of cross member 15 lightly to the garage floor, e.g., by adhesive pads 16 results in similar bending of shaft 11 until the adhesive force is broken. Then the base is free-standing and moves as described above. Regardless of whether the standard 11 rocks forward or bends forward, the driver is provided with a second warning signal and the car is then stopped. In the event that the front portion of the bumper does contact the bottom of bendable shaft 11, it will bend without damaging either the car or the shaft itself, thus permitting some measure of error between its initial set position where it is secured to the base 13 spaced from the front wall of the garage.

It is apparent that by advancing the automobile as shown in FIG. 1 from a position remote from the parking aid (solid line) to a position (phantom line) whereby the front hood, or rear portion, of the car contacts the first visual indicator, viz., the sphere or other first visual warning member 10, a first visual warning is provided to the driver of the car that the vehicle should be stopped or at least driven very slowly and cautiously until contact is made between the front bumper, or rear bumper, thereof as the case may be, with the lower portion of bendable shaft 11.

Assuming the driver heeds this first warning signal, the vehicle will be stopped or at least slowed substantially. However, in the event that it is desired to pull closer to said front wall, the initial signal could be used to serve as an indicator for the driver to apply greater brake pressure permitting the vehicle to move forward very gradually until such time as the front or rear bumper contacts the bendable metal standard 11, viz., the second visual indicator. This second warning member 11 is located in a position further from the vehicle driver and closer to said wall than the first visual warning member 10. Thus there is provided a dual warning sequential visual indicator vehicle parking aid comprising a floor-mounted base means, a first readily deflectable parking limit visual warning member located in a position closer to the driver of said vehicle and further from the wall in the area where said vehicle is parked and suspended from an upper portion of a bendable second parking limit visual warning member by a flexible means joining said second warning member to said first warning member, and wherein said second warning member is located in a position further from the vehicle driver and closer to said wall, is initially selectively bendable to a fixed position and is activated by contact with a bumper on said vehicle whereas said first warning member is activated by contact with the front or rear end thereof so as to give two sequential visual warnings independently of one another.

The bendable metal shaft is preferably formed of a metal or alloy capable of being bent by hand to a configuration such that the distance between the first visual indicator and the portion of the second visual indicator, viz., the metal shaft or standard which is contacted by the bumper, varies in relation to the distance between the upper portion of the front hood (or rear hood upper portion) and the protruding most portion of the front or rear bumper. Thus the distance between the time of the initial hood activated visual warning and the later bumper-activated second visual warning can be varied depending upon the front and rear end configuration of any given vehicle. The bottom portion of the flexible metal standard or shaft is secured in any desired fashion to a support, which can be formed of two cross members, e.g., in a "T" or "X" configuration, joined approximately at the midpoint of one or both of said support members by conventional means such as gluing, screws, nut and bolt combination, etc. Provision can be made to secure the bottom portion(s) of these wooden support members to the floor of the garage temporarily or permanently. Alternatively they need not be secured thereto at all.

Practice with using the subject device can enable the driver of the vehicle desied to be parked to utilize the parking aid and avoid moving the car too far into the garage such as would cause damage to objects stored at the front wall portion thereof, or the front garage wall itself (not shown).

While the base 13 has been illustrated in FIG. 2 as being comprised of two cross members, it should be understood that such base can be formed in an integral or one piece construction. Similarly when a plurality of separate cross members are used, they can be secured in any suitable fashion, such as by the use of screws, nuts and bolts, adhesives, and the like. Base 13 can be made of wood, metal, plastic or equivalent materials and have any desired configuration, including circular, tear-drop shaped, etc.

It will be observed that the flexible means 12 and the bendable second warning member 11 together form an alignment guide for aligning any partial or full reference plane along the long axis of the car body, e.g., the hood line of the car where the hood meets the fender, the centerline of the car, etc., so as to be perpendicular with the front garage wall. This is readily accomplished by presetting the position of bendable member 11 to be generally within the same plane defined by flexible suspending means 12 and the partial or full preference plane along the car body's long axis. The base 13 is then positioned so as to locate this plane substantially perpendicular to the plane defined by the front wall of the garage or other parking area, thus permitting flexible means 12 and bendable member 11 to form an alignment guide for said vehicle. According to one preferred embodiment of this invention the parking aid is set so that the flexible suspending means 12 is substantially parallel to and spaced apart from a portion of said bendable second warning member 11, e.g., an upper portion thereof.

It will be realized that the present invention provides an economical, dual visual warning parking aid device which is capable of giving two sequential visual warnings based upon contact of different portions thereof with different portions of the vehicle being parked and serving as an alignment guide as well.

I claim:

1. A vehicle activated dual (warning sequential) visual indicator vehicle parking aid comprising a floor-mounted base means, a first readily deflectable parking limit visual warning member located in a position closer to the driver of said vehicle and further from the wall in the area where said vehicle is parked and suspended from an upper portion of a bendable second parking limit visual warning member by a flexible means joining said second warning member to said first warning member, wherein said second warning member is connected to said base means and is located in a position further from the vehicle driver and closer to said wall and is initially bendable to a fixed position; whereby said second warning member is activated by contact with a bumper on said vehicle whereas said first warning member is activated by contact with the front or rear-end thereof so as to give two (sequential) visual warnings independently of one another.

2. A parking aid as in claim 1 wherein said flexible means and said bendable second warning member together form an alignment guide for positioning the centerline of said vehicle in a parking space.

3. A parking aid as in claim 1 wherein said base is comprised of a plurality of cross members joined at a location approximately between the ends of one member.

4. A parking aid as in claim 1 wherein said bendable second warning member is a metal tube.

5. A parking aid as in claim 1 wherein said flexible means is substantially parallel with and spaced apart from a portion of said bendable second warning member.

6. A parking aid as in claim 1 wherein said flexible means is a chain.

7. A parking aid as in claim 1 wherein said flexible means is a string or rope.

8. A parking aid as in claim 1 wherein a bottom portion of said base is provided with an adhesive surface for securing said base to the floor of the area where said vehicle is parked.

* * * * *